US008496296B2

(12) United States Patent
Fusao et al.

(10) Patent No.: US 8,496,296 B2
(45) Date of Patent: Jul. 30, 2013

(54) CONNECTING STRUCTURE AND ARTICLE OF FURNITURE HAVING CONNECTING STRUCTURE

(75) Inventors: Yasuda Fusao, Suzuka (JP); Matsumoto Masaki, Suzuka (JP)

(73) Assignee: Sankei Kogyo Co., Ltd. (JP)

( * ) Notice: Subject to any disclaimer, the term of this patent is extended or adjusted under 35 U.S.C. 154(b) by 475 days.

(21) Appl. No.: 12/800,218

(22) Filed: May 11, 2010

(65) Prior Publication Data

US 2011/0025104 A1 Feb. 3, 2011

(30) Foreign Application Priority Data

Jul. 31, 2009 (JP) ..... 2009-179726

(51) Int. Cl.
*A47C 7/00* (2006.01)
*A47C 4/00* (2006.01)
*A47D 1/02* (2006.01)

(52) U.S. Cl.
USPC ..... 297/440.24; 297/58; 297/451.13

(58) Field of Classification Search
USPC ..... 297/440.24, 344.18, 448.2, 451.13, 297/58, 452.2; 403/295, 306, 362, 403
See application file for complete search history.

(56) References Cited

U.S. PATENT DOCUMENTS 3,424,178 A * 1/1969 Yazaki ..... 135/157
3,532,369 A * 10/1970 Reilly ..... 403/176
4,092,049 A * 5/1978 Schoblom ..... 297/440.23
4,298,227 A * 11/1981 Berthier et al. ..... 297/58
4,344,719 A * 8/1982 Thom ..... 403/297
4,548,441 A * 10/1985 Ogg ..... 297/448.2
4,683,634 A * 8/1987 Cole ..... 29/412
4,714,369 A * 12/1987 Souza, Jr. ..... 403/190
4,921,369 A * 5/1990 Chew et al. ..... 403/171
5,634,684 A * 6/1997 Kojima et al. ..... 297/58
5,971,474 A * 10/1999 Chang ..... 297/56
6,435,133 B1 * 8/2002 Wayne, Jr. ..... 119/28.5
7,219,955 B2 * 5/2007 Lu et al. ..... 297/58
7,293,840 B1 * 11/2007 Schu ..... 297/451.13
7,300,059 B2 * 11/2007 Caruso ..... 273/400
7,537,453 B2 * 5/2009 Morgan et al. ..... 434/80
7,753,439 B2 * 7/2010 Akkad ..... 297/23
D630,930 S * 1/2011 Jones et al. ..... D8/349
2003/0234563 A1 * 12/2003 Huang ..... 297/58

FOREIGN PATENT DOCUMENTS

JP 48 57319 7/1973
JP 61 48312 3/1986

* cited by examiner

*Primary Examiner* — David Dunn
*Assistant Examiner* — Richard Lowry
(74) *Attorney, Agent, or Firm* — Adams & Wilks

(57) ABSTRACT

A connecting structure comprises a tubular connection joint and a tubular pipe-shaped cardboard tube for integral engagement with the tubular connection joint. The tubular connection joint is generally curved-shaped and has an insertion portion and a lock projection disposed along a curved inner surface of the insertion portion. The pipe-shaped cardboard tube has an oblique front end portion configured to be inserted into the tubular connection joint so that the oblique front end portion engages between the lock projection and the curved inner surface of the insertion portion.

6 Claims, 4 Drawing Sheets

CONNECTING STRUCTURE AND ARTICLE OF FURNITURE HAVING CONNECTING STRUCTURE

BACKGROUND OF THE INVENTION

1. Field of the Invention

The present invention relates generally to connecting structures for articles of furniture, and more specifically to connecting structures for assembling an article of furniture, such as a chair, and utilizing tubular parts made of a cardboard material.

2. Background Information

Furniture connecting structures using pipes made of a metal material, such as forelegs and back legs of chairs, are known. Legs for chairs and other types of furniture have also been fabricated using a cardboard material. For example, JP-A-61-48312 discloses a chair using hollow cardboard square tubes so that even children can handle. JP-UM-A-48-57319 proposes a chair and rack for storage formed of long cardboard tubes.

However, various problems arise in connecting structures for furniture when, as a joint for connecting pipe-like cardboard tubes, an L-shaped joint having a pipe material curved in an L-shape is used for connection. Namely, when the front end of a cardboard tube is inserted into the joint curved in an L-shape, the front end abuts against the curved inner face and cannot move further forwardly. Accordingly, the connection portion of the cardboard tube with the joint is shortened, whereby it is likely to become loose and the connection strength is lowered.

When the joint and the cardboard tube are fixed with a fitting screw, if a force is applied in such a direction acting to rotate the cardboard tube, a load concentrating at the fitting screw portion is large enough such that the fitting screw portion becomes subjected to breakage. To avoid such problem, in the chair disclosed in JP-A-61-48312 a square columnar insertion portion bent at a right angle is formed as a joint, and the cardboard tube is formed in a hollow square columnar shape so that it can be inserted into this insertion portion. Further, in the chair proposed in JP-UM-A-48-57319, at the side portion of a cylindrical connecting device, a projection protruding in a direction at a right angle is disposed, and a long cardboard tube is inserted thereinto. Accordingly, in JP-A-61-48312 and JP-UM-A-48-57319, the chairs are fabricated using connecting joint portions formed only at right angles such that loads are applied perpendicularly to legs, thereby reducing the possibility of breakage as noted above.

Thus, while it has been possible to fabricate a chair using a cardboard tube connecting structure such that loads are applied perpendicularly to the chair legs, it has been difficult to fabricate chairs using cardboard tube connecting structures with connecting joint portions other than at right angles such as, for example, a chair having a slanting leg or a chair having a corner portion curved in an L-shape, like for conventional folding chairs with legs made of metal pipes. Furthermore, the conventional folding chairs have such a risk that children's fingers are nipped by a movable portion during handling of the folding chairs. Additionally, the conventional chairs made of cardboard tube connecting structures lack sufficient strength and durability.

SUMMARY OF THE INVENTION

It is an object of, the present invention to provide a connecting structure that includes a tubular part made of a cardboard material and that exhibits sufficient strength and durability for use in the construction of various types of articles of furniture including, but not limited to, chairs, sofas, tables, desks and storage racks.

It is another object of the present invention to provide a connecting structure having a pipe-shaped cardboard tube and a tubular connection joint with a curved-shaped insertion portion into which the pipe-shaped cardboard tube is inserted to form the connecting structure with sufficient strength and durability for use in the construction of articles of furniture, including a chair having slanting legs.

It is yet another object of the present invention to provide a durable, lightweight folding chair utilizing the connecting structure of the present invention.

The foregoing and other objects of the present invention are carried out by a connecting structure comprising a curved-shaped tubular connection joint having an insertion portion and a lock projection disposed along a curved inner surface of the insertion portion, and a pipe-shaped cardboard tube having an oblique front end portion configured to be inserted into the tubular connection joint so that the oblique front end portion engages between the lock projection and the curved inner surface of the insertion portion.

In an exemplary embodiment, the lock projection has a front end slanted to conform with a slant angle of the oblique front end portion of the pipe-shaped cardboard tube so that in a state in which the oblique front end portion is inserted into the tubular connection joint, the oblique front end portion engages the slanted front end of the lock projection to substantially prevent relative rotation between the tubular connection joint and the pipe-shaped cardboard tube. Preferably, the tubular connection joint is substantially L-shaped, and the oblique front end portion of the pipe-shaped cardboard tube has a slant angle of 45°.

Preferably, the connecting structure further comprises connectors that integrally connect the pipe-shaped cardboard tube to the tubular connection joint in a state in which the oblique front end portion of the pipe-shaped cardboard tube is inserted into the tubular connection joint and the oblique front end portion engages between the lock projection and the curved inner surface of the insertion portion. In one embodiment, the connectors comprise a nut integrally mounted in a fitting hole in the pipe-shaped cardboard tube and a screw that is inserted through a hole formed in the tubular connection joint for integral engagement with the nut.

In another aspect, the present invention is directed to an article of furniture comprising a plurality of pipe-shaped cardboard tubes each having at least one oblique front end portion, and a plurality of curved-shaped tubular connection joints each having an insertion portion and a lock projection disposed along a curved inner surface of the insertion portion, the insertion portions of the tubular connection joints being configured to receive the respective oblique front end portions of the pipe-shaped cardboard tubes so that for each pipe-shaped cardboard tube and corresponding tubular connection joint, the oblique front end portion engages and fits tightly between the lock projection and the curved inner surface of the insertion portion.

In an exemplary embodiment, the article of furniture is a folding chair. The pipe-shaped cardboard tubes form a pair of front legs, a pair of rear legs, and a pair of connection tubes for the chair. The tubular connection joints comprise two pair of tubular connection joints, one of the connection tubes connecting the pair of front legs to one another via one of the pair of tubular connection joints and the other of the connection tubes connecting the pair of rear legs to one another via the other of the pair of tubular connection joints.

The folding chair has a seat portion pivotally connected to top portions of the rear legs and to intermediate portions of the front legs, and a pair of connecting members pivotally connecting respective top portions of the rear legs to respective portions of the front legs disposed between the seat portion and the back portion. Each of the connecting members has a first portion with an outer diameter substantially equal to an outer diameter of the corresponding rear leg and with an upper end pivotally connected to the portion of the corresponding front leg, and a second portion formed at a lower end of the first portion and having a diameter smaller than the first portion and that is inserted into the corresponding rear leg via the top portion thereof, the second portion having a groove configured to receive a pin that extends through the seat portion and the corresponding rear leg to pivotally connect the seat portion to the corresponding rear leg.

According to one feature of the present invention, the second portion of each connecting member has a diameter dimensioned to form a gap between the second portion and the corresponding front leg sufficient to prevent nipping of a user's fingers between the second portion and the corresponding front leg during a folding operation.

In a preferred embodiment, the upper end of the first portion of each connecting member is provided with a bracket pivotally secured to and in contact with opposite side surfaces of the corresponding front leg. For each connecting member and corresponding rear leg, a cushion member is disposed between the lower end of the first portion and the top portion of the rear leg to provide a buffer between the lower end of the first portion and the top portion of the rear leg to prevent injury to fingers of the user of the folding chair. For each of the connecting members, the bracket is substantially U-shaped as seen in a horizontal direction and is pivotally connected to the corresponding front leg so that a space is formed between a bottom portion of the bracket and the corresponding front leg to prevent nipping of the user's fingers during use of the folding chair.

Thus by the connecting structure of the present invention, it is possible to secure the connection and improve the connection strength between the curved-shaped tubular connection joints and pipe-shaped cardboard tubes along the entire connection length and to substantially prevent relative rotation between the tubular connection joints and the pipe-shaped cardboard tubes, while avoiding breakage of connectors integrally connecting the pipe-shaped cardboard tube to the tubular connection joint in a state in which the oblique front end portion of the pipe-shaped cardboard tube is inserted into the tubular connection joint and the oblique front end portion engages and fits tightly between the lock projection and the curved inner surface of the insertion portion.

The connecting structure of the present invention is also suitable for the fabrication of various types of articles of furniture including, but not limited to, chairs, sofas, tables, desks and storage racks. When the connecting structure of the present invention is particularly used in the fabrication of chairs, a plurality of the pipe-shaped cardboard tubes are used to fabricate front legs, rear legs and connection tubes for the chair and a plurality of the curved-shaped tubular connection joints integrally connect the front legs, rear legs and connection tubes together to form the chair. The connecting structure of the present invention also enables front and rear legs of articles of furniture, such as folding chairs, to be disposed in slant form which has been difficult to achieve with conventional cardboard chairs. Furthermore, the article of furniture according to the present invention provides means for preventing injury (e.g., nipping of the user's fingers) to the user of the article of furniture (e.g., folding chair), such as during use by children.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

Figure 1:
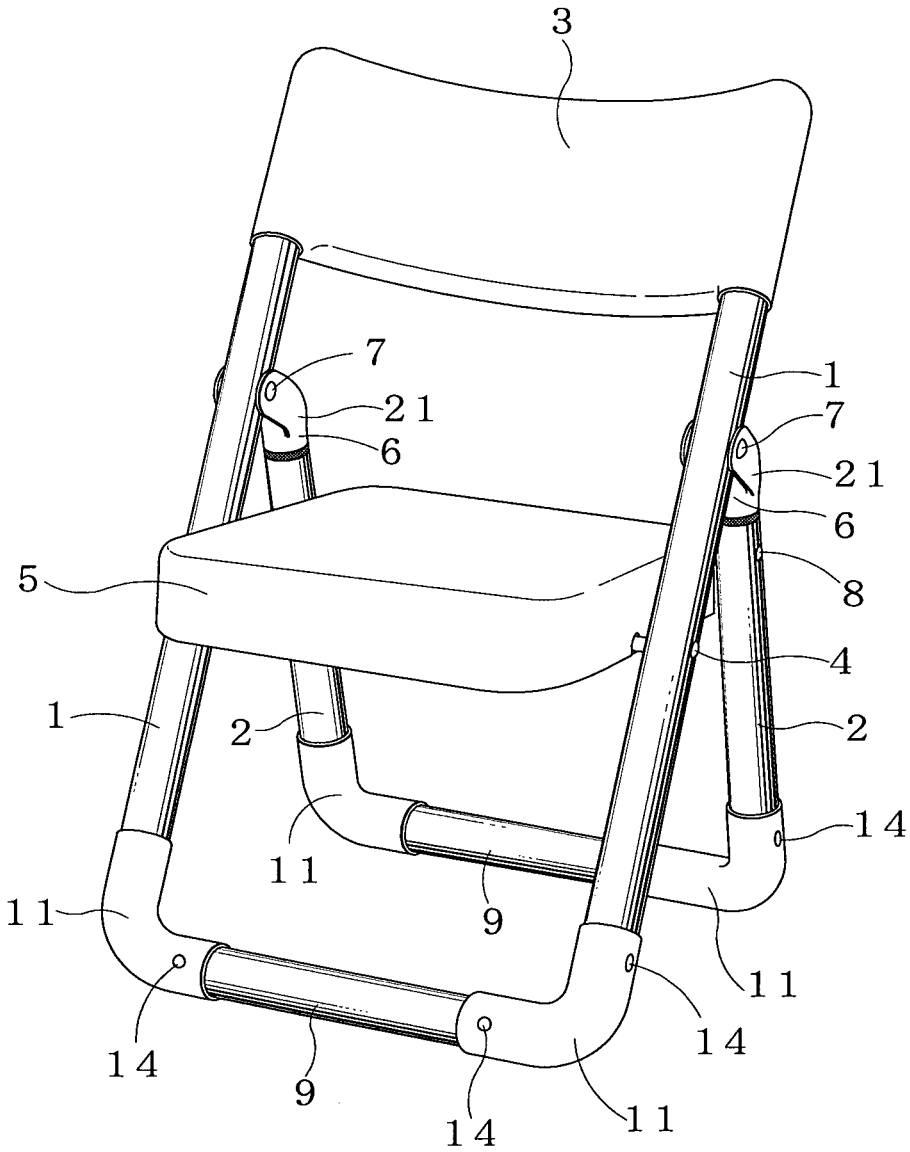
FIG. 1 is a perspective view of an article of furniture in the form of a folding chair employing the connecting structure according to an embodiment of the present invention.

While this invention is susceptible of embodiments in many different forms, this specification and the accompanying drawings disclose only presently preferred embodiments of the invention. The invention is not intended to be limited to the embodiments so described, and the scope of the invention will be pointed out in the appended claims.

Certain terminology is used in the following description for convenience only and is not intended to be limiting. The words right, left, front, top, rear, back, upper, lower, inner, outer, rearwardly and forwardly designate directions in the drawing to which reference is made. Such terminology includes the words above specifically mentioned and words of similar import.

The preferred embodiment of the connecting structure and related features and advantages of the present invention is described below with a specific application to a folding chair. However, it will be appreciated by those of ordinary skill in the art that the connecting structure and related features and advantages of the present invention are also specifically well adapted for articles of furniture other than folding chairs including, but not limited to, non-folding chairs, sofas, tables, desks and storage racks.

Referring now to the drawings in detail, wherein like numerals are used to indicate like elements throughout, there is shown in FIGS. 1-6 exemplary embodiments of a connecting structure and a folding chair utilizing the connecting structure according to the present invention. In the exemplary embodiment shown in FIG. 1, the folding chair of the present invention has forelegs (front legs) 1, back legs (rear legs) 2, a back portion 3 mounted to upper ends of the forelegs 1, and a seat portion 5 pivotally secured with a connection shaft 4 at intermediate portions of the forelegs 1. As described in more detail below, upper ends of the back legs 2 are pivotally secured with pin connectors 7 to the forelegs 1 through connecting members 6, and the back legs 2 are pivotally secured to the seat portion 5 with pin connectors 8. Floor pipes (connection tubes) 9 integrally connect respective lower ends of the forelegs 1 to one another and respective lower ends of the back legs 2 to one another via connecting structures as further described below.

Each of the forelegs 1, back legs 2 and floor pipes 9 are fabricated from cardboard tubing, preferably pipe-shaped cardboard tubes. For example, a commercially available recycled paper material of predetermined width is wound spirally to form each of the pipe-shaped cardboard tubes. Each of the pipe-shaped cardboard tubes has an outer diameter of 33.4 mm and an inner diameter of 17.5 mm, for example. The back portion 3 and seat portion 5 are preferably made of a suitable metal or plastic material.

Figure 2:
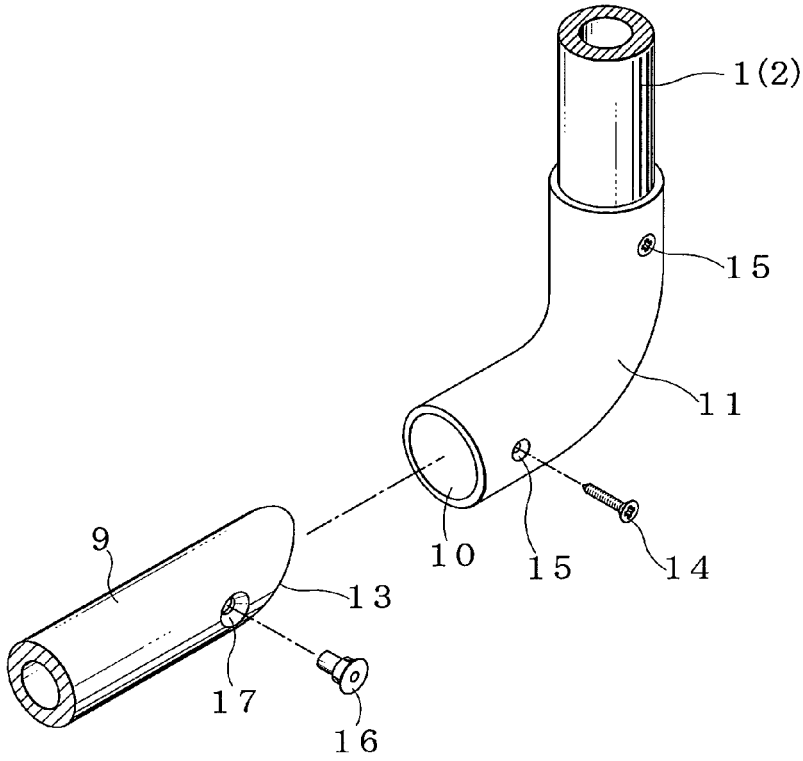
FIG. 2 is a partial exploded perspective view of the connecting structure of the present invention showing the connection between a leg and a connection tube of the chair shown in FIG. 1.
Figure 3:
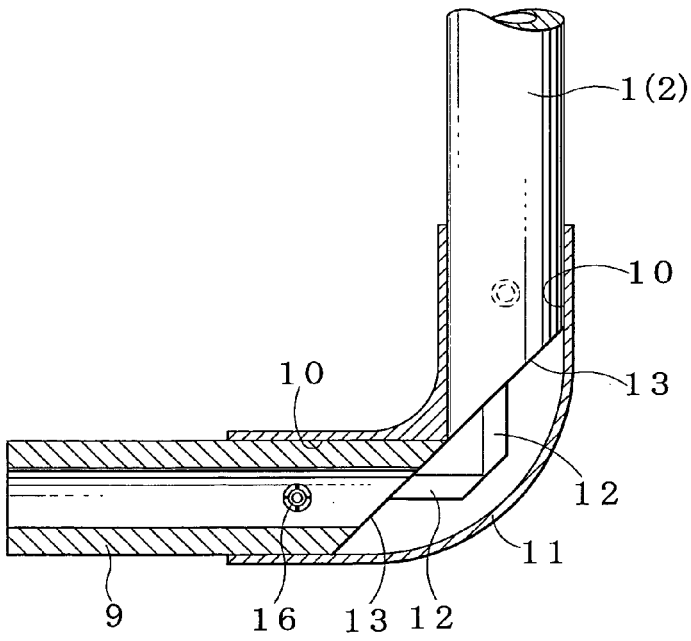
FIG. 3 is a cross-sectional view of the connecting structure according to the present invention.
Figure 4:
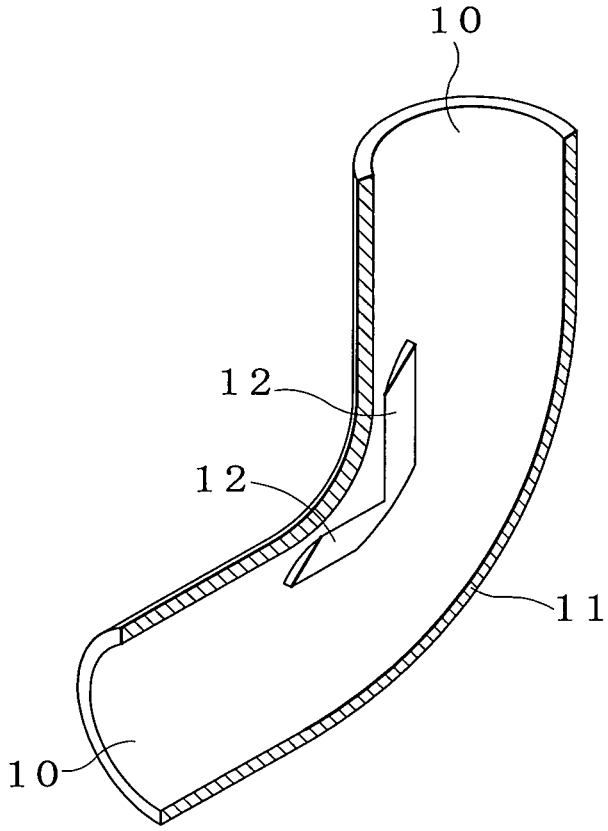
FIG. 4 is a cross-sectional perspective view showing a curved-shaped tubular connection joint with lock projection of the connecting structure according to the present invention.

FIGS. 2-4 illustrate the connecting structure for connecting the floor pipes 9 to the forelegs 1 and back legs 2. In basic form, the connecting structure includes a curved-shaped tubular connection joint 11 having an insertion portion 10 and a lock projection 12 provided along a curved inner wall surface of the insertion portion 10, and a pipe-shaped cardboard tube (e.g., the floor pipe 9 in exemplary embodiment of the folding chair shown in FIG. 1) configured to be inserted into the insertion portion 10 of the tubular connection joint 11. The pipe-shaped cardboard tube 9 has an oblique (i.e., cut obliquely) front end portion 13 that engages and fits tightly between the lock projection 12 and the curved inner surface of the insertion portion 10 when the pipe-shaped cardboard tube 9 is inserted into the insertion portion 10 of the tubular connection joint 11. The pipe-shaped cardboard tube 9, and each of the forelegs 1 and back legs 2 as described below, has an outer diameter that is slightly smaller than an inner diameter of the tubular connection joint 11 to enable the front end portion 13 of the pipe-shaped cardboard tube 9 to be inserted into insertion portion 10, as shown in FIG. 3.

As shown in FIGS. 3 and 4, the lock projection 12 has a front end slanted to conform with a slant angle of the oblique front end portion 13 of the pipe-shaped cardboard tube 9 so that in a state in which the oblique front end portion 13 is inserted into the tubular connection joint 11, the oblique front end portion 13 extends along and engages the slanted front end of the lock projection 12 to substantially prevent relative rotation between the tubular connection joint 11 and the pipe-shaped cardboard tube 9. Preferably, the oblique front end portion 13 of the pipe-shaped cardboard tube 9 has a slant angle of 45°. The tubular connection joint 11 is preferably substantially L-shaped and is manufactured from of a suitable plastic material, such as polypropylene (PP).

As best shown in FIG. 3, the pipe-shaped cardboard tube 9 has a fitting hole 17 to which a nut 16 is fixed. The tubular connection joint 11 has a hole 15 to which a fitting screw 14 is inserted for engagement with the nut 16 in a state in which the oblique front end portion 13 of the pipe-shaped cardboard tube 9 is inserted into the tubular connection joint 11 and the oblique front end portion 13 engages and fits tightly between the lock projection 12 and the curved inner surface of the insertion portion 10. By this construction, relative rotation between the tubular connection joint 11 and the pipe-shaped cardboard tube 9 is further substantially prevented. Thus the holes 15, 17 of the tubular connection joint 11 and the pipe-shaped cardboard tube 9, and the fitting screw 14 and nut 16 define connecting means for integrally connecting the pipe-shaped cardboard tube 9 to the tubular connection joint 11, in a state in which the oblique front end portion 13 of the pipe-shaped cardboard tube 9 is inserted into the tubular connection joint 11 and the oblique front end portion 13 engages and fits tightly between the lock projection 12 and the curved inner surface of the insertion portion 10, to substantially prevent relative rotation between the tubular connection joint 11 and the pipe-shaped cardboard tube 9.

In the exemplary embodiment shown in FIGS. 3-4, the curved-shaped tubular connection joint 11 has opposite open ends and the insertion portion 10 extends between the opposite open ends. As best shown in FIG. 4, the lock projection 12 is formed in one piece with the tubular connection joint 11 and is bent in a substantial L-shape along the curved inner wall surface of the insertion portion 10 to conform to the substantially L-shaped tubular connection joint 11, thus forming two lock projection end portions. Each open end of the tubular connection joint 11 is configured to receive a front end portion 13 of one of the pipe-shaped cardboard tubes. More specifically, as shown in FIGS. 3-4, the floor pipe 9 and one of the foreleg 1 or the back leg 2, as the pipe-shaped cardboard tubes, are inserted into the insertion portion 10 of the tubular connection joint 11 via the respective open ends of the tubular connection joint 11 so that the oblique front end portions 13 of the pipe-shaped cardboard tubes engage and fit tightly between the curved inner surface of the insertion portion and respective end portions of the lock projection 12. Preferably, the tubular connection joint 11 and the lock projection 12 are constructed in one piece from a single piece of material, such as polypropylene.

As described above for the basic form of the connecting structure according to the present invention, each end portion of the lock projection 12 is slanted to conform with a slant angle (e.g., 45°) of the oblique front end portion 13 of the corresponding pipe-shaped cardboard tube so that in a state in which the oblique front end portions 13 are inserted into the tubular connection joint 11, the oblique front end portions 13 extend along and engage the respective slanted end portions of the lock projection to substantially prevent relative rotation between the tubular connection joint 11 and the pipe-shaped cardboard tubes. Likewise, the tubular connection joint 11 is provided with two holes 15 and each pipe-shaped cardboard tube 9 is provided with a fitting hole 17, and nuts 16 and fitting screws 14 are provided for integrally connecting the pipe-shaped cardboard tubes to the tubular connection joint 11, in a state in which the oblique front end portion 13 of the pipe-shaped cardboard tubes are inserted into the tubular connection joint 11 and the oblique front end portions 13 engage and fit tightly between the curved inner surface of the insertion portion 10 and the respective end portions of the lock projection 12, to substantially prevent relative rotation between the tubular connection joint 11 and the pipe-shaped cardboard tubes.

As described above, in the embodiment shown in FIG. 4, the lock projection 12 is formed in one piece with the tubular connection joint 11 and is bent in a substantial L-shape providing two lock projection end portions for engagement with respective oblique front end portions 13 of the pipe-shaped cardboard tubes. Alternatively, the lock projection 12 may be formed as two separate portions provided along the curved inner surface of the insertion portion 10 of the tubular connection joint 11 for engagement with respective oblique front end portions 13 of the pipe-shaped cardboard tubes. In the exemplary embodiments, the pipe-shaped cardboard tubes 1, 2 and 9 have a generally circular cross-sectional shape. It is understood, however, that other cross-sectional shapes are suitable for the pipe-shaped cardboard tubes, such as square, rectangular or other suitable cross-sectional shapes, with the tubular connection joint 11 being provided with a corresponding cross-sectional shape to accommodate insertion therein of the pipe-shaped cardboard tubes as described herein.

Figure 5:
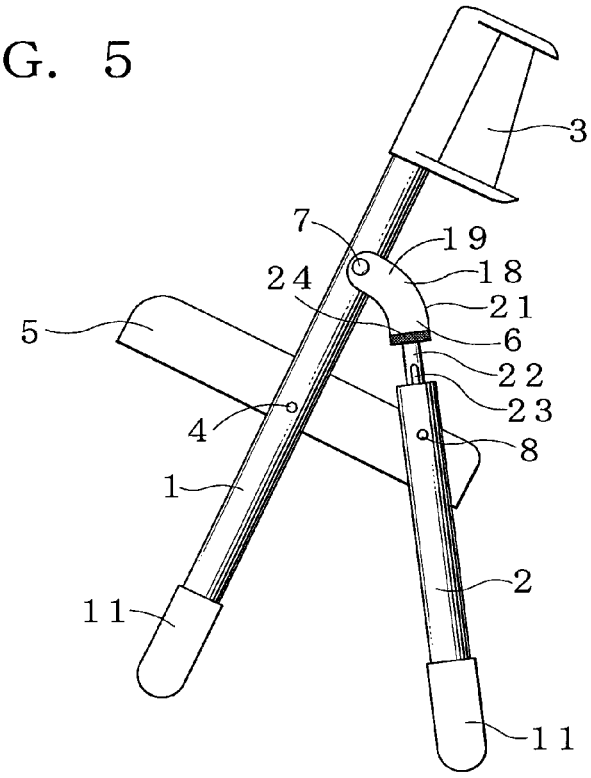
FIG. 5 is a side view of a folding chair utilizing the connecting structure of the present invention and shown in the process of being folded.
Figure 6:
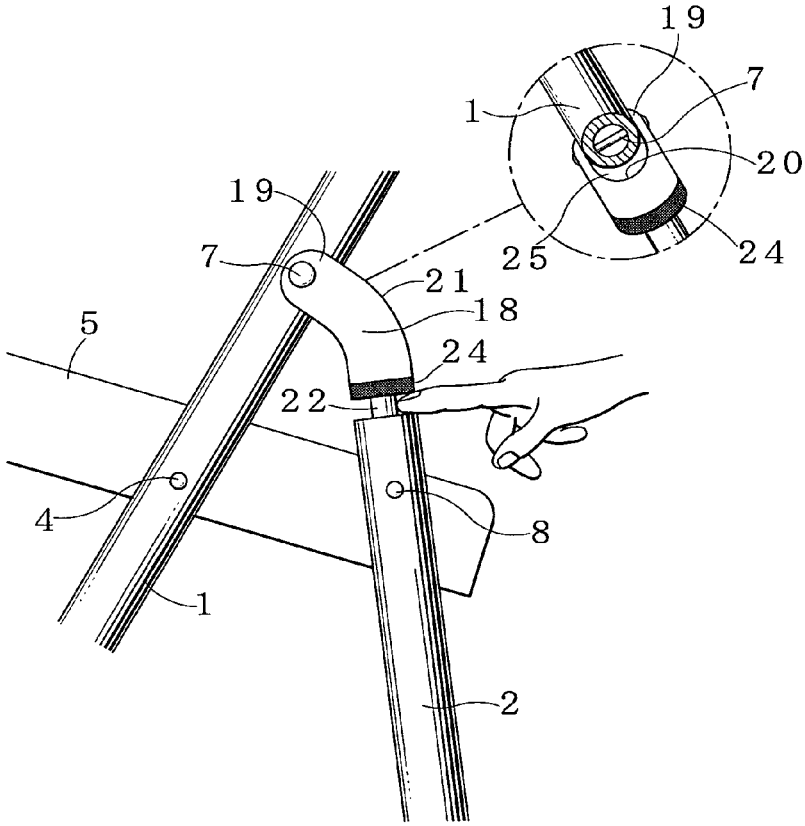
FIG. 6 is an explanatory view of the folding chair utilizing the connecting structure of the present invention and illustrating the means for preventing injury to the user's fingers during use of the folding chair.

Referring now to FIGS. 1, 5 and 6, the seat portion 5 is pivotally connected to top portions of the back legs 2 and to intermediate portions of the forelegs 1. A pair of connecting members 6 pivotally connect respective top portions of the back legs 2 to respective portions of the forelegs 1 disposed between the seat portion 5 and the back portion 3. Each of the connecting members 6 has a generally cylindrical first portion 21 with an outer diameter substantially equal to an outer diameter of the corresponding back leg 2 and with an upper end 18 pivotally connected to the portion of the corresponding foreleg 1, and a second portion 22 formed at a lower end of the first portion 21 and having a diameter smaller than the first portion 21 and that is inserted into the corresponding back leg 2 via the top portion thereof. The second portion 22 has a groove 23 configured to receive the pin 8 that extends through the seat portion 5 and the corresponding back leg 2 to pivotally connect the seat portion 5 to the corresponding back leg 2. Each of the connecting members 6 is preferably constructed from a plastic resin material, such as polyamide (e.g., nylon-6), and 30% by weight of glass fibers (PA6+GF30%).

The pivotable connections between the seat portion 5, forelegs 1 and back legs 2 connect the seat portion 5, forelegs 1 and back legs 2 of the chair in a folding fashion. Thus, the diameter of the second portion 22 of each connecting member 6 is preferably selected to form a gap between the second portion 22 and the corresponding foreleg 1 sufficient to prevent nipping of a user's fingers between the second portion 22 and the corresponding foreleg 1 during a folding operation. Preferably, in a folded state of the folding chair, the gap separates the second portion 22 of the connecting member 6 from the corresponding foreleg 1 to provide a distance between the second portion 22 and corresponding foreleg 1 ranging from 17 mm at a location proximate the top portion of the corresponding back leg 2 to 22 mm at a location proximate the lower end of the first portion 21 of the connecting member 6.

Moreover, for each connecting member 6 and corresponding back leg 2, a flexible cushion member 24 is disposed between the lower end of the first portion 21 and the top portion of the corresponding back leg 2 for providing a buffer between the lower end of the first portion 21 and the top portion of the back leg 2. By this structure, even in the case in which a user's finger is nipped between the lower end of the first portion 21 and the top portion of the corresponding back leg 2, as shown in FIG. 6, the flexible cushion member 24 provides a buffer that prevents injury to the user's finger. Preferably, the flexible cushion member 24 is made of an olefin-type elastomer.

The upper end 18 of the first portion 21 of each connecting member 6 is provided with a bracket 19 pivotally secured to the corresponding foreleg 1 via corresponding pins 7. The bracket 19, which is substantially U-shaped as seen in a horizontal direction, is disposed in contact with opposite side surfaces of the corresponding forelegs 1. As shown in the enlarged portion of the folding chair assembly in FIG. 6, a space 25 is formed between a bottom portion 20 of the bracket 19 and the corresponding foreleg 1 to prevent nipping of the user's fingers during use of the folding chair. For example, the space 25 is preferably dimensioned to provide a distance of at least 15 mm between the bottom portion 20 of the bracket 19 and the corresponding foreleg 1.

By the foregoing description, it will be appreciated that the present invention provides a connecting structure that includes a pipe-shaped cardboard tube and a tubular connection joint with a curved-shaped insertion portion into which the pipe-shaped cardboard tube is inserted to form the connecting structure exhibiting sufficient strength and durability for use in the construction of lightweight articles of furniture, such as a folding chair. It is also appreciated that the present invention can be employed to fabricate folding chairs of different sizes, such as by varying the diameters and lengths of the pipe-shaped cardboard tubes that form the legs of the folding chair.

Thus by the connecting structure of the present invention, it is possible to secure the connection and improve the connection strength between curved-shaped tubular connection joints and pipe-shaped cardboard tubes along the entire connection length and to substantially prevent relative rotation between the tubular connection joints and the pipe-shaped cardboard tubes, while avoiding breakage of connectors (e.g., screws) integrally connecting the pipe-shaped cardboard tube to the tubular connection joint in a state in which the oblique front end portion of the pipe-shaped cardboard tube is inserted into the tubular connection joint and the oblique front end portion engages and fits tightly between the lock projection and the curved inner surface of the insertion portion.

The connecting structure of the present invention is also suitable for the fabrication of various types of articles of furniture other than chairs including, but not limited to, sofas, tables, desks and storage racks. The connecting structure of the present invention also enables front and rear legs of articles of furniture, such as folding chairs, to be disposed in slant form which has been difficult to achieve with conventional cardboard chairs. Furthermore, the article of furniture according to the present invention provides means for preventing injury (e.g., nipping of the user's fingers) to the user of the article of furniture (e.g., folding chair), such as during use by children.

While the present invention has been described in terms of specific embodiments, it is to be understood that the invention is not limited to these disclosed embodiments. This invention may be embodied in many different forms and should not be construed as limited to the embodiments set forth herein; rather, these embodiments are provided by way of illustration only and so that this disclosure will be thorough, complete and will fully convey the full scope of the invention to those skilled in the art. Indeed, many modifications and other embodiments of the invention will come to mind of those skilled in the art to which this invention pertains, and which are intended to be and are covered by both this disclosure, the drawings and the claims.

We claim:

1. A chair having pipe-shaped cardboard tubes that form a pair of front legs, a pair of rear legs, and a pair of connection tubes, each cardboard tube having at least one oblique front end portion; and two pair of tubular connection joints, one of the connection tubes connecting the pair of front legs to one another via one of the pair of tubular connection joints and the other of the connection tubes connecting the pair of rear legs to one another via the other of the pair of tubular connection joints, each tubular connection joint having opposite open ends, an insertion portion and a lock projection disposed along a curved inner surface of the insertion portion, and each tubular connection joint having the oblique front end portions of two cardboard tubes inserted into respective opposite open ends thereof so that the oblique front end portions fit tightly between the lock projection and the curved inner surface of the insertion portion.

2. A chair according to claim 1; further comprising a back portion mounted to an upper end of each of the front legs and a seat portion pivotally connected to an intermediate portion of each of the front legs; wherein upper ends of the rear legs are pivotally connected to the respective front legs at portions of the front legs disposed between the respective intermediate and upper ends thereof; and wherein the one pair of tubular connection joints connect to respective lower ends of the front legs and the other pair of tubular connection joints connect to respective lower ends of the rear legs.

3. A chair according to claim 1; further comprising a seat portion pivotally connected to top portions of the rear legs and to intermediate portions of the front legs, and a pair of connecting members pivotally connecting respective top portions of the rear legs to respective portions of the front legs disposed between the seat portion and the back portion; wherein each of the connecting members has a first portion with an outer diameter substantially equal to an outer diameter of the corresponding rear leg and with an upper end pivotally connected to the portion of the corresponding front leg, and a second portion formed at a lower end of the first portion and having a diameter smaller than the first portion and that is inserted into the corresponding rear leg via the top portion thereof, the second portion having a groove configured to receive a pin that extends through the seat portion and the corresponding rear leg to pivotally connect the seat portion to the corresponding rear leg; and wherein the pivotable connections between the seat portion, the front legs and rear legs connect the seat portion, front legs and rear legs of the chair in a foldable fashion.

4. A chair according to claim 3; wherein the upper end of the first portion of each connecting member is provided with a bracket pivotally secured to and in contact with opposite side surfaces of the corresponding front leg; and wherein for each connecting member and corresponding rear leg, a cushion member is disposed between the lower end of the first portion and the top portion of the rear leg that provides a buffer between the lower end of the first portion and the top portion of the rear leg to prevent injury to fingers of the user of the folding chair.

5. A chair according to claim 4; wherein for each of the connecting members, the bracket is substantially U-shaped as seen in a horizontal direction and is pivotally connected to the corresponding front leg so that a space is formed between a bottom portion of the bracket and the corresponding front leg to prevent nipping of the user's fingers during use of the folding chair.

6. A chair according to claim 3; wherein the second portion of each connecting member has a diameter dimensioned to form a gap between the second portion and the corresponding front leg sufficient to prevent nipping of a user's fingers between the second portion and the corresponding front leg during a folding operation.

* * * * *